US008215980B1

(12) United States Patent
Lin

(10) Patent No.: US 8,215,980 B1
(45) Date of Patent: Jul. 10, 2012

(54) CONNECTOR HAVING A HOUSING WITH PARTITION WALLS WITH HOOKED PORTIONS AND PIVOTALLY COUPLED COVER SHELLS

(75) Inventor: Yen-Lin Lin, New Taipei (TW)

(73) Assignee: Jyh Eng Technology Co., Ltd., New Taipei (TW)

( * ) Notice: Subject to any disclaimer, the term of this patent is extended or adjusted under 35 U.S.C. 154(b) by 0 days.

(21) Appl. No.: 13/085,654

(22) Filed: Apr. 13, 2011

(51) Int. Cl.
*H01R 4/24* (2006.01)

(52) U.S. Cl. ..... 439/404

(58) Field of Classification Search ..... 439/468, 439/409, 467, 857, 395, 404
See application file for complete search history.

(56) References Cited

U.S. PATENT DOCUMENTS 4,538,874 A * 9/1985 Dambach et al. ..... 439/407
5,178,558 A * 1/1993 Knox et al. ..... 439/404
5,358,430 A 10/1994 Bonvallat et al.
5,947,761 A 9/1999 Pepe
5,957,720 A 9/1999 Boudin
5,980,337 A * 11/1999 Little ..... 439/857
7,713,081 B2 * 5/2010 Chen ..... 439/468
7,918,684 B2 * 4/2011 Lu ..... 439/395
2011/0207364 A1 * 8/2011 Metral et al. ..... 439/404

* cited by examiner

*Primary Examiner* — Chandrika Prasad
(74) *Attorney, Agent, or Firm* — Guice Patents PLLC

(57) ABSTRACT

A keystone jack based on a punch down type keystone jack architecture, having a wire layout cover attached to the rear side of the jack body and two cover shells pivotally connected to the jack body for closing/opening the wire layout cover. The IDC housing at the back side of the jack body has a wire-bonding block panel formed of multiple partition plates and a retaining hook located on the distal end of each partition plate to minimize the gap between each two adjacent partition plates, allowing installation of the core wires of the inserted network cable by a punch down type technique or a tool free type technique.

5 Claims, 4 Drawing Sheets

CONNECTOR HAVING A HOUSING WITH PARTITION WALLS WITH HOOKED PORTIONS AND PIVOTALLY COUPLED COVER SHELLS

BACKGROUND OF THE INVENTION

1. Field of the Invention

The present invention relates to network connectors and more particularly, to a keystone jack, which allows selective connection arrangement between the wire-bonding block panel of the IDC housing and the core wires of the network cable by a punch down technique or a tool free technique.

2. Description of the Related Art

A network cable is an 8-core cable for signal transmission. A keystone jack is for connection between the system end and the network cable for signal transmission. A regular keystone jack generally includes a jack body disposed at the front side and an IDC (insulation displacement contact) housing disposed at the rear side. The jack body has a forwardly extending jack hole defined therein for receiving a keystone plug of a network cable, and 8 gold-plated pins arranged in the jack hole for the contact of the matching conducting pins of the inserted keystone plug. The IDC housing is adapted for receiving a network cable from the system end.

The connection arrangement between the wire-bonding block panel of the IDC housing and the core wires of the network cable can be done in either of the following two ways:

1. The punch down type to punch down the core wires into the wire-bonding block panel with a tool.

2. The tool free type to hold down the core wires in the wire-bonding block panel with a cover plate.

Similar techniques can see the related descriptions of U.S. Pat. Nos. 5,957,720; 5,947,761; 5,358,430.

Commercial keystone jacks use one of the aforesaid two methods to achieve connection between the wire-bonding block panel of the IDC housing and the core wires of the network cable. Thus, the installation of a punch down type keystone jack must use a tool to punch down the core wires into the wire-bonding block panel. When a tool free type keystone jack is used, it has a holding down mechanism for holding down the core wires of the network cable in the wire-bonding block panel. No any commercial keystone jack allows selective connection arrangement between the wire-bonding block panel of the IDC housing and the core wires of the network cable by a punch down technique or a tool free technique.

SUMMARY OF THE INVENTION

The present invention has been accomplished under the circumstances in view. It is main object of the present invention to provide a keystone jack, which allows selective connection arrangement between the wire-bonding block panel of the IDC housing and the core wires of the network cable by a punch down type technique or a tool free type technique.

To achieve this and other objects of the present invention, a keystone jack comprises a jack body having a plurality of gold-plated pins arranged in a front jack hole thereof, an insulation displacement contact housing arranged at the rear side of the jack body and having a wire-bonding block panel formed of a plurality of partition plates and a hooked portion located on the distal end of each partition plate, a wire layout cover, which is attached to the rear side of the insulation displacement contact housing opposite to the jack body and comprises an insertion hole for the insertion of a network cable, a bracket structure located on the inner side thereof for securing the core wires of the inserted network cable in a suspended manner for enabling a suspended part of each of the core wires to be forced into the gap between each two adjacent ones of the partition plates of the insulation displacement contact housing, and two cover shells bilaterally pivotally coupled to the rear side of the jack body and movable relative to each other between an open position where the insulation displacement contact housing is exposed to the outside of the jack body, and a close position where the cover shells keep the insulation displacement contact housing from sight. Further, each cover shell comprises a plurality of press blocks bilaterally located on the inner side thereof for pushing the wire layout cover forward.

Thus, the core wires of the inserted network cable are pressable into the gap between each two adjacent ones of said partition plates by a punch down tool. Alternatively, the core wires of the inserted network cable are pressable into the gap between each two adjacent ones of the partition plates by means of the wire layout cover after fastening of the core wires to the bracket structure to let a part of each of the core wires be suspended in the bracket structure.

DETAILED DESCRIPTION OF THE PREFERRED EMBODIMENT

Figure 1:
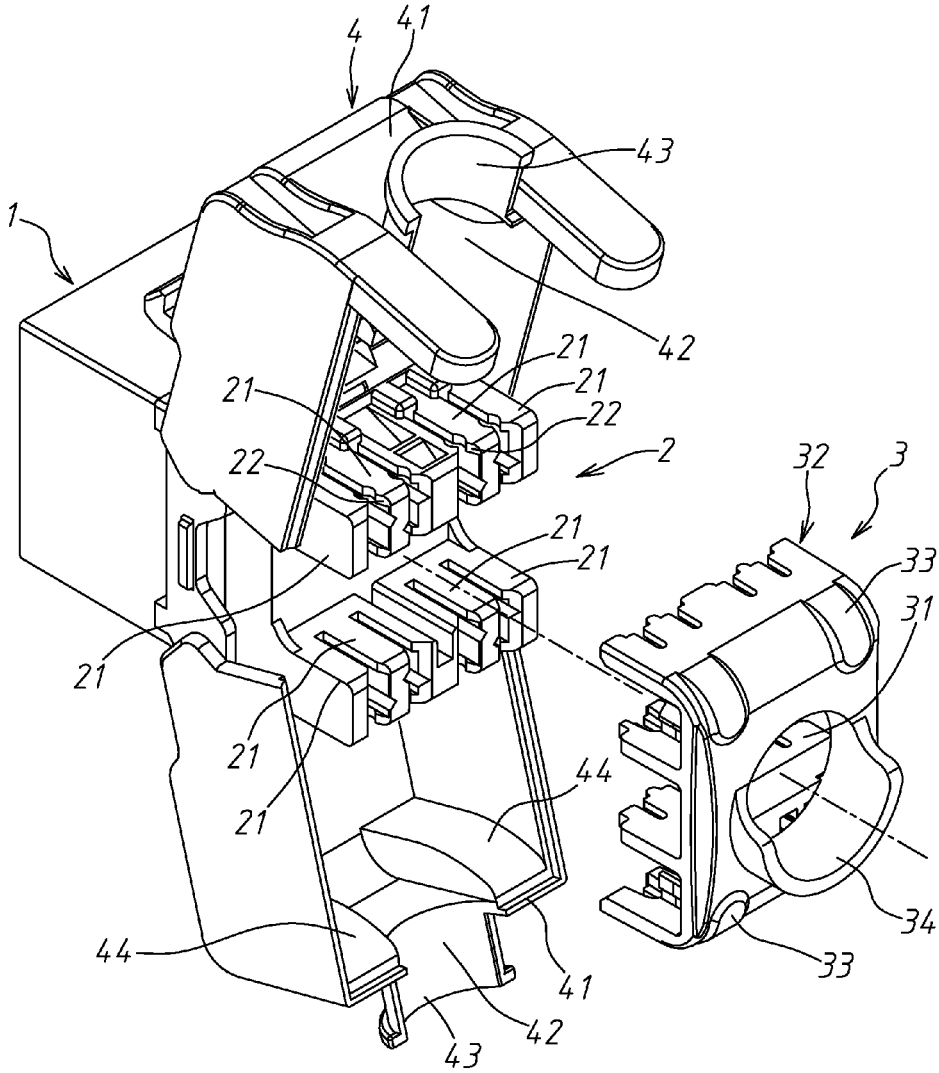
FIG. 1 is an exploded view of a keystone jack in accordance with the present invention.

Referring to FIG. 1, a keystone jack in accordance with the present invention is shown comprising a jack body 1, an IDC (insulation displacement contact) housing 2, a wire layout cover 3 and two cover shells 4.

Figure 1A:
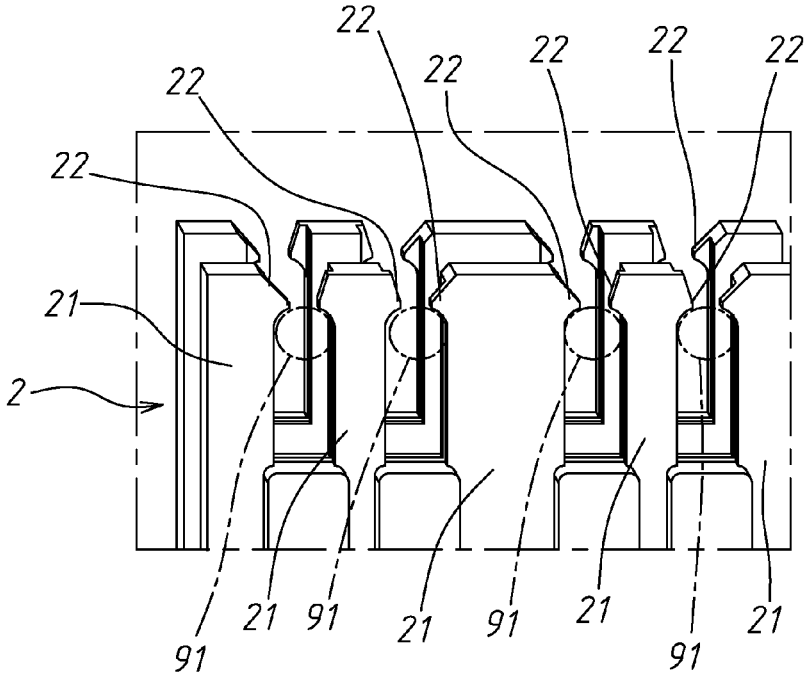
FIG. 1A is an enlarged view of a part of FIG. 1, illustrating the structure of the partition plates of the IDC (insulation displacement contact) housing.

The jack body 1 has a plurality of gold-plated pins arranged in a front jack hole thereof (not shown). With respect to the design of the jack hole and the arrangement of the gold-plate pins in the jack hole, please refer to the prior art techniques. The IDC (insulation displacement contact) housing 2 is arranged at the rear side of the jack body 1, having a wire-bonding block panel formed of a plurality of partition plates 21, as shown in FIG. 1A. Further, hooked portions 22 are respectively located on the distal end of each of the partition plates 21 to narrow the gap between each two adjacent partition plates 21, facilitating positioning of one respective core wire 91 in the gap between each two adjacent partition plates 21.

Figure 1B:
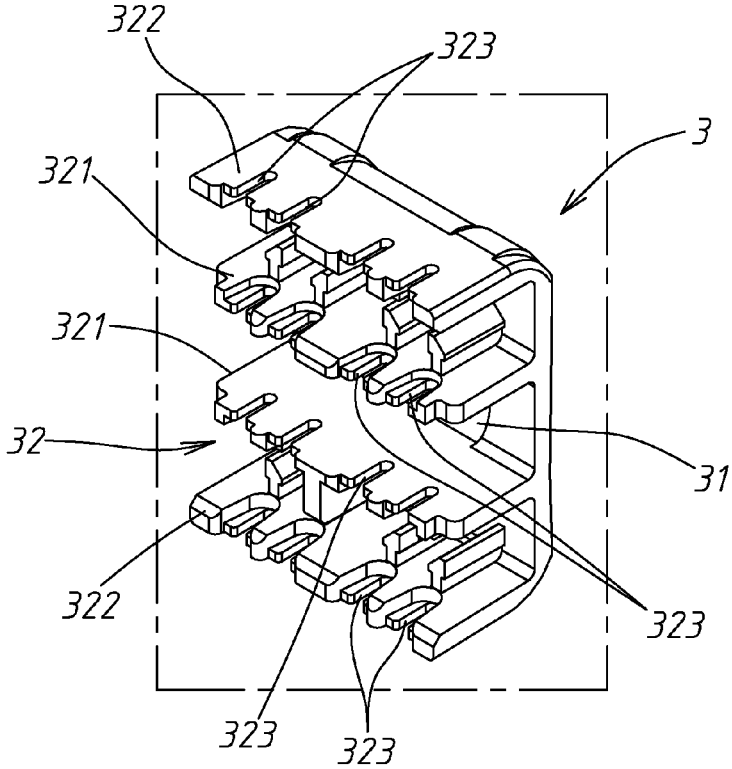
FIG. 1B is an oblique elevational view of the wire layout cover shown in FIG. 1 when viewed from another angle.
Figure 2A:
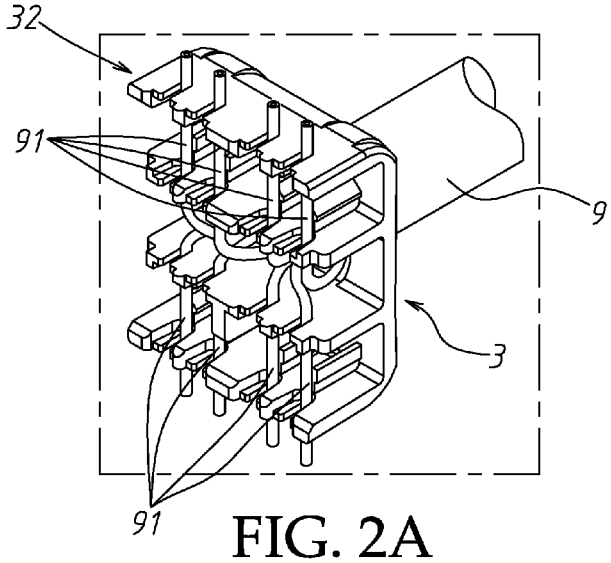
FIG. 2A is a schematic drawing of the present invention, illustrating the core wires of the network cable arranged in the wire layout cover.
Figure 2:
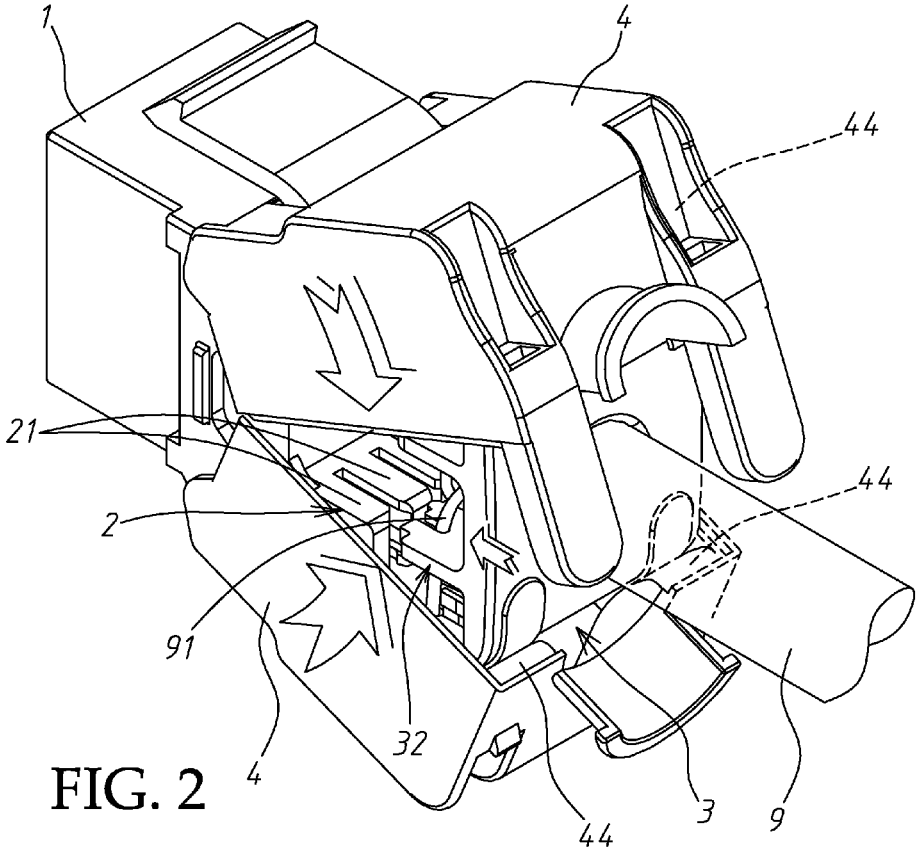
FIG. 2 is a schematic drawing of the present invention, illustrating tool free type installation of the keystone jack.

The wire layout cover 3 is attached to the rear side of the IDC (insulation displacement contact) housing 2, comprising an insertion hole 31 for the insertion of a network cable, a circularly arched flange 34 backwardly extended from the outside wall thereof around the lower half of the insertion hole 31 for supporting the inserted network cable, a bracket structure 32 located on the inner side thereof for securing the core wires 91 of the inserted network cable 9 in a suspended manner, as shown in FIG. 2A, enabling the suspended part of each of the core wires 91 to be forced into the gap between each two adjacent ones of the partition plates 21 of the IDC (insulation displacement contact) housing 2. As shown in FIG. 1B, the bracket structure 32 comprises two outer brackets 322 and two inner brackets 321. Each of the brackets 321;322 has a plurality of retaining notches 323 for securing the core wires 91, enabling the core wires 91 to be suspended in the bracket structure 32 for mounting, as shown in FIG. 2A. Further, the wire layout cover 3 has reinforcing ribs 33 to reinforce its structural strength.

The cover shells 4 are bilaterally pivotally coupled to the rear side of the jack body 1, and movable relative to each other between an open position where the IDC (insulation displacement contact) housing 2 is exposed to the outside, and a close position where the IDC (insulation displacement contact) housing 2 is kept from sight. Each cover shell 4 has a semicircular flange 43 located on the rear wall 41 thereof, and press blocks 44 located on the inside. When the cover shells 4 are closed, the two semicircular flanges 43 are abutted against each other, defining an insertion hole 42 for the passing of the network cable 9. Further, when the cover shells 4 are closed, the press blocks 44 are stopped against the wire layout cover 3 opposite to the reinforcing ribs 33, preventing the wire layout cover 3 from damage.

Figure 3:
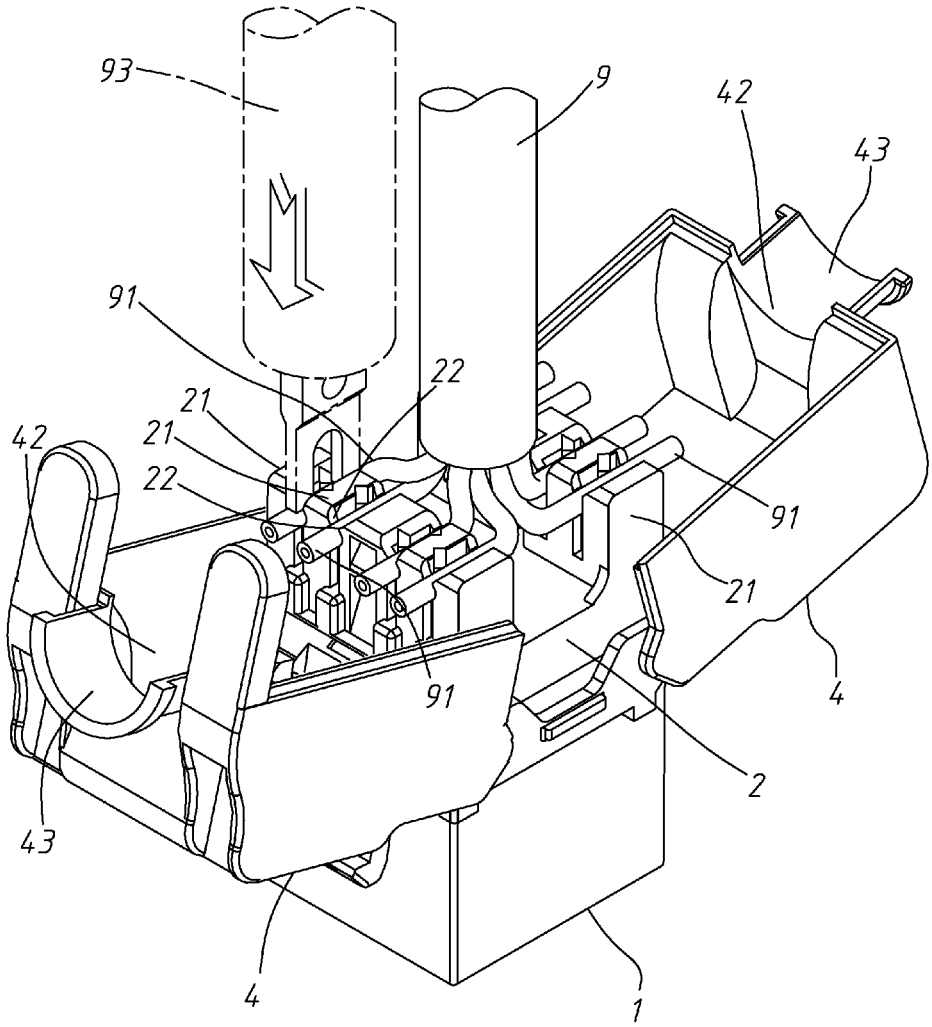
FIG. 3 is a schematic drawing of the present invention, illustrating punch down type installation of the keystone jack.

In one installation example of the present invention, as shown in FIG. 3, a tool 93 is used. At this time, set the core wires 91 of the network cable 9 in the gap between each two adjacent ones of the partition plates 21 of the IDC (insulation displacement contact) housing 2 to let the core wires 91 be hooked by the hooked portions 22, and then use the tool 93 to punch down the core wires 91, forcing the core wires 91 into electric contact with the respective insulation-piercing contacts (not shown) at the bottom side in the gap between each two adjacent ones of the partition plates 21 of the IDC (insulation displacement contact) housing 2. At this time, the hooked portions 22 prevent the core wires 91 from escaping out of the wire-bonding block panel. Thereafter, close the cover shells 4, enabling the network cable 9 to pass through the insertion hole 42 and to be supported by the semicircular flanges 43.

In another installation example of the present invention, as shown in FIG. 2A, the network cable 9 is inserted through the insertion hole 31 of the wire layout cover 3, and then the core wires 91 of the network cable 9 are respectively secured to the retaining notches 323 of the brackets 321;322 of the bracket structure 32, and then the wire layout cover 3 is attached to the rear side of the IDC (insulation displacement contact) housing 2, and then the cover shells 4 are closed to force the press blocks 44 against the wire layout cover 3 opposite to the reinforcing ribs 33. At this time, the core wires 91 of the network cable 9 are respectively forced into the between each two adjacent ones of the partition plates 21 of the IDC (insulation displacement contact) housing 2 and into electric contact with the respective insulation-piercing contacts (not shown) in the wire-bonding block panel.

Further, the keystone jack of the present invention is based on a punch down type keystone jack architecture with two cover shells 4 pivotally arranged at the rear side of the jack body 1 of the keystone jack, thus, the single wire-bonding block panel fits punch down installation as well as tool free installation. Further, the gap between each two adjacent partition plates 21 of the IDC (insulation displacement contact) housing 2 is relatively greater than that of a conventional punch down type keystone jack to facilitate insertion of the suspended part of each of the core wires 91 at the bracket structure 32 of the wire layout cover 3 into the wire-bonding block panel of the IDC (insulation displacement contact) housing 2. Further, in order to prevent escaping of the core wires 91 out of the partition plates 21 of the IDC (insulation displacement contact) housing 2, the partition plates 21 are designed to have a respective hooked portions 22 near the respective distal end to narrow the width of the gap. Thus, punch down type or tool free type can be selectively employed.

Further, during installation of the present invention, a punch down tool 93 shown in FIG. 3 as well as a Krone-type tool can be selectively used. Further, the keystone jack of the invention fits any of a variety of network cables 9 ranging from 5.5 mm-9 mm and core wires 91 ranging from 23-26 AWG (American Wire Gauge).

In conclusion, the invention provides a keystone jack that allows installation of a network cable 9 by means of a punch down type installation or tool free type installation technique to force the core wires 91 of the network cable 9 into the wire-bonding block panel of its IDC (insulation displacement contact) housing 2.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A keystone jack network connector for use with punch down and tool free insulation displacement contacts, the keystone jack network connector comprising:

a jack body comprising a plurality of gold-plated pins arranged in a front jack hole thereof;

an insulation displacement contact housing arranged at a rear side of said jack body, said insulation displacement contact housing comprising a wire-bonding block panel having a plurality of partition plates and a hooked portion located directly on a distal end of each said partition plates, said plurality of partition plates and each said hooked portion are integrally formed with said insulation displacement contact housing;

a wire layout cover attached to a rear side of said insulation displacement contact housing opposite to said jack body, said wire layout cover comprising an insertion hole for the insertion of a network cable, a bracket structure located on an inner side of said wire layout cover for securing core wires of the inserted network cable in a suspended manner for enabling a suspended part of each of said core wires to be forced into a gap located between each two adjacent ones of said partition plates and secured therein by a corresponding hooked portion of said insulation displacement contact housing; and two cover shells bilaterally pivotally coupled to the rear side of said jack body and movable relative to each other between an open position where said insulation displacement contact housing is exposed to the outside of said jack body, and a closed position where said cover shells enclosing said insulation displacement contact housing, each said cover shell comprising a plurality of press blocks bilaterally located on an inner side thereof for pushing said wire layout cover forward, when said two cover shells are moving from said open position to said closed position, said plurality of press blocks pressing and moving said wire layout cover towards said insulation displacement contact housing;

wherein the core wires of the inserted network cable are pressable into the gap between each two adjacent ones of said partition plates by a punch down tool;

alternatively the core wires of the inserted network cable are pressable into the gap between each two adjacent ones of said partition plates by means of said wire layout cover after fastening of the core wires to said bracket structure to let a part of each of the core wires be suspended in said bracket structure.

2. The keystone jack network connector as claimed in claim 1, wherein said wire layout cover comprises a plurality of reinforcing ribs respectively disposed corresponding to the press blocks of said cover shells.

3. The keystone jack network connector as claimed in claim 1, wherein said wire layout cover comprises a circularly arched flange backwardly extended from an outside wall thereof around a lower half of the insertion hole thereof for supporting the inserted network cable.

4. The keystone jack network connector as claimed in claim 1, wherein the bracket structure of said wire layout cover comprises two outer brackets and two inner brackets, each of said outer brackets and said inner brackets having a plurality of retaining notches for securing the core wires of the inserted network cable for enabling the core wires of the inserted network cable to be suspended in said bracket structure for mounting.

5. The keystone jack network connector as claimed in claim 1, wherein each said cover shell further comprises a semicircular flange located on a rear wall thereof, the semicircular flanges of said two cover shells being abutted against each other to define an insertion hole for the passing of the network cable that is inserted into the insertion hole of said wire layout cover when said two cover shells are closed.

* * * * *